US007063231B2

(12) United States Patent
Stanos et al.

(10) Patent No.: US 7,063,231 B2
(45) Date of Patent: Jun. 20, 2006

(54) CONTAINER INCLUDING A BOWL AND A LID EACH HAVING INTERFITTING LIPS

(75) Inventors: Lawrence C. Stanos, Midland, MI (US); Jeffrey J. Zettle, Bay City, MI (US); Peter T. Evers, Jr., Sanford, MI (US); Donald E. Hodge, Clare, MI (US)

(73) Assignee: S. C. Johnson Home Storage, Inc., Racine, WI (US)

( * ) Notice: Subject to any disclaimer, the term of this patent is extended or adjusted under 35 U.S.C. 154(b) by 0 days.

(21) Appl. No.: 10/455,519

(22) Filed: Jun. 6, 2003

(65) Prior Publication Data

US 2004/0245261 A1 Dec. 9, 2004

(51) Int. Cl.
*B65D 41/16* (2006.01)

(52) U.S. Cl. ..... 220/793; 220/4.21

(58) Field of Classification Search ..... 220/780, 220/781, 784, 787–793, 796, 805, 4.21, 4.24, 220/4.25

See application file for complete search history.

(56) References Cited

U.S. PATENT DOCUMENTS

| | | | | |
|---|---|---|---|---|
| 3,516,572 | A | 6/1970 | Davis | |
| 3,532,244 | A | 10/1970 | Yates, Jr. | |
| 3,612,342 | A | 10/1971 | Rathbun | |
| 3,692,208 | A | 9/1972 | Croyle et al. | |
| 3,722,731 | A | 3/1973 | McCormick et al. | |
| 3,743,131 | A | 7/1973 | Croyle et al. | |
| 3,779,418 | A | 12/1973 | Davis | |
| 4,027,776 | A | 6/1977 | Douglas | 220/281 |
| 4,141,463 | A | 2/1979 | Smith | |
| 4,418,833 | A | 12/1983 | Landis | |
| 4,426,014 | A | 1/1984 | Coltman, Jr. | |
| 4,632,272 | A | 12/1986 | Berenfield et al. | |
| 4,721,210 | A | 1/1988 | Lawrence et al. | 206/459 |
| 4,836,407 | A * | 6/1989 | Bruce et al. | 220/276 |
| 5,085,340 | A | 2/1992 | Doxey et al. | |
| 5,147,059 | A | 9/1992 | Olsen et al. | |
| 5,377,860 | A | 1/1995 | Littlejohn et al. | |
| 5,377,861 | A | 1/1995 | Landis | |
| 5,383,565 | A | 1/1995 | Luch | |
| 5,520,939 | A | 5/1996 | Wells | |
| 5,575,398 | A | 11/1996 | Robbins, III | |
| 5,992,679 | A | 11/1999 | Porchia et al. | |
| 6,032,827 | A | 3/2000 | Zettle et al. | |
| 6,056,138 | A | 5/2000 | Chen | |
| 6,168,044 | B1 | 1/2001 | Zettle et al. | |
| 6,170,696 | B1 | 1/2001 | Tucker et al. | |
| 6,467,647 | B1 | 10/2002 | Tucker et al. | |
| 6,733,852 | B1 * | 5/2004 | Littlejohn et al. | 428/35.7 |
| 2002/0037378 | A1 | 3/2002 | Littlejohn et al. | 428/36.5 |

FOREIGN PATENT DOCUMENTS

| | | |
|---|---|---|
| WO | WO 99/67147 | 12/1999 |
| WO | WO 00/64771 | 11/2000 |

* cited by examiner

*Primary Examiner*—Lien M. Ngo

(57) ABSTRACT

A container (2) includes a bowl (20) and a lid (10). The lid (10) includes a lid lip (16) having a generally inverted U-shape and the bowl (20) includes a bowl lip (26) having a generally inverted U-shape such that the lid lip (16) and the bowl lip (26) interfit, forming mutually opposing surfaces, with the lid lip (16) superposing the bowl lip (26). At least one of the bowl lip (26) and the lid lip (16) includes a seal in firm contact with the opposing surface, with the seal contacting the opposing surface in a small area relative to a total surface area of the bowl lip (26).

13 Claims, 10 Drawing Sheets

CONTAINER INCLUDING A BOWL AND A LID EACH HAVING INTERFITTING LIPS

BACKGROUND OF THE INVENTION

1. Field of the Invention

This invention relates to a container comprising a bowl and a lid and, in particular, a container comprising a bowl and a lid each having interfitting lips.

2. Description of the Background of the Invention

Consumers have a variety of food storage needs, including storing leftover solid foods such as lasagna, semi-solid foods such as stews, and liquids such as soups. Containers for storing items such as these foods come in a variety of shapes, sizes and levels of quality. Typically, however, the container includes a bowl or other receptacle and a lid that fits on the bowl and seals the bowl in some way. High quality containers exhibit excellent sealing characteristics, such that even soups will not spill out of the container regardless of the orientation of the container. However, these high quality containers can be so expensive that they are virtually unusable for fear of losing them.

There has been an ongoing demand for less expensive containers that exhibit some of the characteristics of the more expensive containers, such as excellent sealing between the bowl and the lid. Excellent sealing is difficult to achieve with the inexpensive containers, however, because such containers are typically mass-produced, such as in a thermoforming process, using inexpensive materials such as polypropylene. To maintain cost-effectiveness, the materials used are typically at least slightly flexible or are thin enough to be flexible, because such materials or material thicknesses tend to be less expensive and easier to manufacture. However, very rigid materials or thick-walled components, which may be on the order of 80 mils (203 thousandths of a centimeter), have generally been necessary to provide a leak-tight seal between the lid and the bowl.

Another characteristic of high quality containers for which there is high demand in inexpensive containers relates to "plus" factors, or finishing touches. For example, consumers demand containers that provide some feedback indicating whether the lid has been secured onto the bowl. Such feedback may include aural or tactile feedback.

With regard to the seal, U.S. Pat. No. 6,170,696 to Tucker, et al. discloses a "nearly leak tight seal." The seal in that patent, however, can be difficult to manufacture successfully. The seal area of the Tucker, et al. patent includes a plurality of linear segments on the sides and the top that are in contact with their opposing surfaces to create a seal. This arrangement makes manufacturing tolerances a significant concern, because if any single surface is too long or too short, the other surfaces will not fit together properly.

Accordingly, there is a need in the art for an inexpensive container that exhibits some of the characteristics of more expensive containers, such as strong seals to contain liquid and solid foods, and one which provides aural or tactile feedback indicating closure.

SUMMARY OF THE INVENTION

According to one aspect of the invention, a container comprises a bowl and a lid. The lid comprises a lid lip having a generally inverted U-shape and the bowl comprises a bowl lip having a generally inverted U-shape such that the lid lip and the bowl lip interfit, with the lid lip superposing the bowl lip. The lid lip includes an inner hook and an outer hook, and the bowl lip and the lid lip are dimensioned such that the inner hook and the outer hook clamp the bowl lip. Further, at least one of the bowl lip and the lid lip includes a sealing means in firm contact with an opposing surface, with the sealing means contacting the opposing surface in a small area relative to a total surface area of the bowl lip.

According to another aspect of the invention, a container comprises a bowl comprising a base, a sidewall defining an opening and a bowl lip having a generally inverted U-shape and including at least one undercut, and a lid comprising a main body portion being oversized with respect to the opening of the bowl and a lid lip disposed on a periphery of the main body portion. The lid lip has a generally inverted U-shape such that the lid lip and the bowl lip interfit, with the lid lip superposing the bowl lip. The lid lip includes an inner hook and an outer hook, each having a curved shape to contact a small area of the bowl lip relative to a total external surface area of the bowl lip when the lid is secured to the bowl. The bowl lip and the lid lip are dimensioned such that the inner hook and the outer hook clamp the bowl lip and at least one of the inner hook and the outer hook engages the undercut. The inner hook is in firm contact with the undercut when the lid is secured to the bowl. At least one of the bowl lip and the lid lip include rumble strips for generating feedback to a user as the lid is placed on the bowl.

According to yet another aspect of the invention, a container comprises a bowl and a lid. The bowl comprises a base, a sidewall defining an opening and a bowl lip having a generally inverted U-shape and including (i) at least one undercut and (ii) a protrusion. The lid comprises a main body portion being oversized with respect to the opening in the bowl, and a lid lip disposed on a periphery of the main body portion, the lid lip having a generally inverted U-shape such that the lid lip and the bowl lip interfit, with the lid lip superposing the bowl lip. The lid lip includes a hook shaped to contact a small area of the bowl lip relative to a total external surface area of the bowl lip when the lid is secured to the bowl. The bowl lip and the lid lip are dimensioned such that the hook and the protrusion in the bowl lip cause the lid lip to clamp the bowl lip. At least one of the bowl lip and the lid lip includes rumble strips for generating feedback to a user as the lid is placed on the bowl.

According to still another aspect of the invention, a container comprises a bowl and a lid. The bowl comprises a base, a sidewall extending from the base and defining an opening and a bowl lip having a generally inverted U-shape terminating in an outwardly extending flange. The lid comprises a main body portion being oversized with respect to the opening in the bowl and a lid lip disposed on a periphery of the main body portion, the lid lip having a generally inverted U-shape such that the lid lip and the bowl lip interfit, with the lid lip completely covering a top of the bowl lip. A seal is formed between the lid lip and the bowl lip, with the seal consisting of a small area of contact between the bowl lip and the lid lip relative to a total external surface area of the bowl lip. The bowl lip and the lid lip are substantially out of contact with each other except for the seal.

In another aspect of the invention, a method of securing a bowl to a lid comprises the step of placing a lid, comprising a main body portion and a lid lip on a periphery of the main body portion, onto a bowl comprising a base, a sidewall extending from the base and a bowl lip extending from the sidewall, the sidewall defining an opening. The method further comprises the step of sliding an inner hook and an outer hook disposed on the lid lip along inner and outer walls of the bowl lip, engaging the outer hook with an outer undercut formed in the bowl lip, contacting a seal ring with a top of the bowl lip, and engaging the inner hook with an inner undercut formed in the bowl lip. The engagement of the inner and outer hooks with the inner and outer undercuts secures the bowl to the lid.

In yet another aspect of the invention, a container comprises a bowl and a lid. The bowl comprises a base, a sidewall defining an opening and a bowl lip having a generally inverted U-shape and including an undercut. The lid comprises a main body portion being oversized with respect to the opening of the bowl, a lid lip disposed on a periphery of the main body portion and a spring element. The lid lip has a generally inverted U-shape such that the lid lip and the bowl lip interfit, with the lid lip superposing the bowl lip. The spring element presses the lid lip against the bowl lip. A cavity is formed between a top of the bowl lip and a top of the lid lip.

DETAILED DESCRIPTION OF THE PREFERRED EMBODIMENTS

Figure 1:
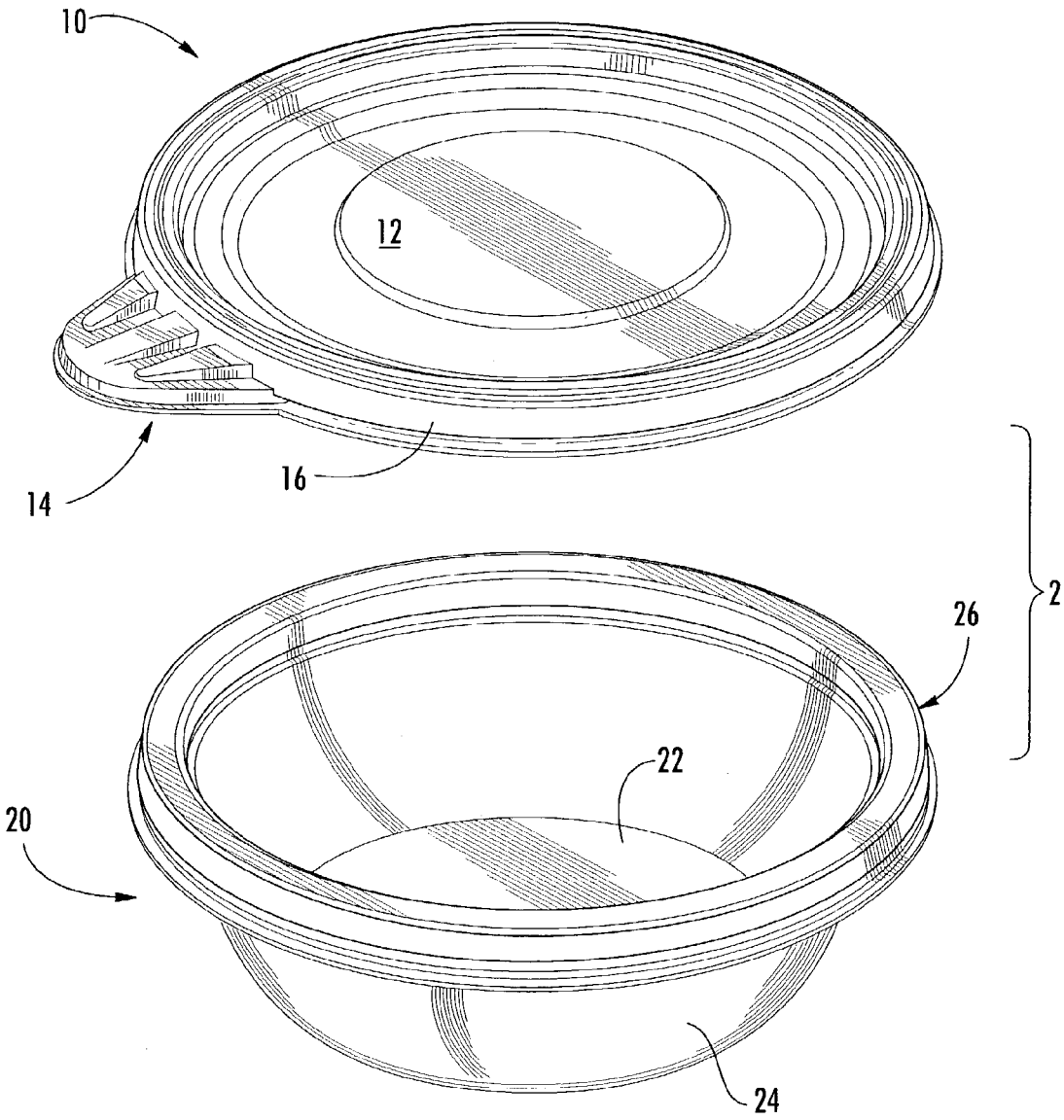
FIG. 1 is an exploded, perspective view of a container according to a first embodiment of the present invention.

FIG. 1 is an exploded, perspective view of a container 2 according to a first embodiment of the invention. The container 2 generally comprises a lid 10 and a bowl 20, which are preferably made of a resilient material, such as polypropylene. The lid is preferably about 15 to about 25 mils (38–64 thousandths of a centimeter), inclusive, in thickness, and most preferably about 20 mils (51 thousandths of a centimeter) in thickness. The bowl is preferably about 30 mils (76 thousandths of a centimeter) in thickness. Of course, the lid and the bowl may be thicker or thinner, as costs dictate.

As shown in FIGS. 1 and 2A–2D, the lid 10 includes a generally planar main body portion 12, a tab 14 and a lid lip 16 having generally the shape of an inverted U. The bowl 20 includes a generally planar base 22, an upwardly and outwardly extending sidewall 24 defining an opening, and a bowl lip 26 adapted to interfit with the lid lip 16. As will be described in more detail below, the engagement between the bowl 20 and the lid 10 can generally be described as an interference fit, in which the inner dimension of the lid 10 is larger than the opening in the bowl 20. The interference fit causes the lid 10 to press against the bowl 20, thus frictionally engaging the bowl 20 to generate a seal between the bowl 20 and the lid 10. This seal, and the engagement of the lid 10 with the bowl 20 generally, are discussed in detail below.

In each of the following embodiments, reference is made to cross-sectional views of the bowl and lid lips. The placement of the section line is not important because the features of the bowl and lid lips are substantially the same regardless of where the cross section is taken. (However, it will be understood that the tab 14 will alter the cross section of the outside of the lid lip. Also, on rectangularly shaped bowls and lids, wall thicknesses are generally thicker in the corners and thinner along the sides.) Moreover, although FIG. 1 depicts a round bowl and lid, it should be appreciated that the features of the bowl and lid lips depicted in the other figures will be substantially the same regardless of the shape (e.g., round, square, oval, rectangular) of the container.

Figure 2A:
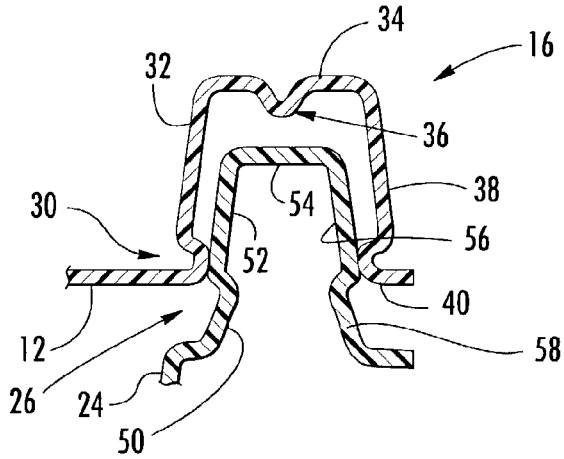
FIGS. 2A–2D are partial cross-sectional views of lid and bowl lips according to the first embodiment of the present invention showing how the lid engages the bowl.

FIGS. 2A–2D show, in cross section, the lid lip 16 at various stages as it interfits with the bowl lip 26. The lid lip 16 includes an inner hook 30 extending in the form of a reverse C from the main body portion 12 of the lid. An inner wall 32 extends from the inner hook 30 to a substantially horizontal top 34. The top 34 includes a seal ring or bead 36, which is preferably a downward protrusion formed in the top 34 having a curved surface. The top 34 leads into an outer sidewall 38, which in turn leads into an outer hook 40. As shown in FIG. 2A, the lid lip 16 is generally symmetrical about the seal ring 36.

The bowl lip 26 is also substantially symmetrical about a center line, and comprises an inner undercut 50 extending from the sidewall 24 of the bowl. An inner wall 52 extends from the top of the inner undercut 50 and is substantially planar and inwardly directed toward the center line. A substantially horizontal and planar top 54 bridges the gap between the inner wall 52 and an outer wall 56, which is substantially planar and outwardly directed. An outer undercut 58 extends below the outer wall 56.

The operation of the inner and outer hooks 30, 40, the inner and outer undercuts 50, 58 and the seal ring 36 to engage the lid with the bowl is best understood with reference to FIGS. 2A–2D. A consumer first loosely places the lid on the bowl and, as shown in FIG. 2A, subsequently presses down on the lid so that the inner hook 30 and the outer hook 40 slide along the inner wall 52 and the outer wall 56 of the bowl lip 26. The consumer may press on the main body portion 12 of the lid, and this is preferred, but the consumer typically presses on the top 34 of the lid lip 16. As the lid is pressed down over the bowl, the inner hook 30 and the outer hook 40 are forced away from each other by virtue of the outwardly extending inner and outer walls 52, 56 of the bowl lip 26.

Figure 2B:
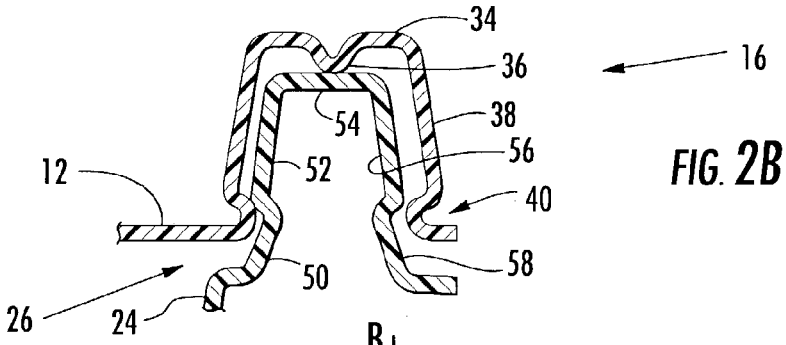
Figure 2C:
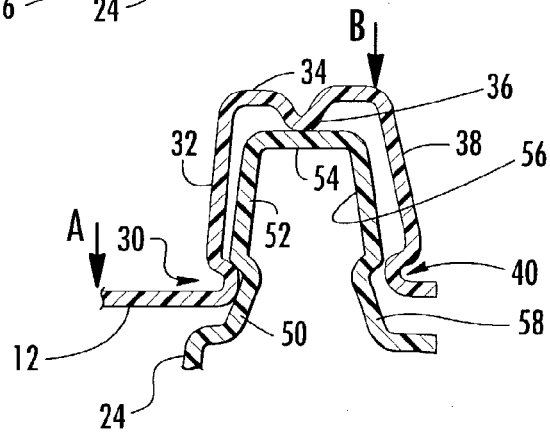
Figure 2D:
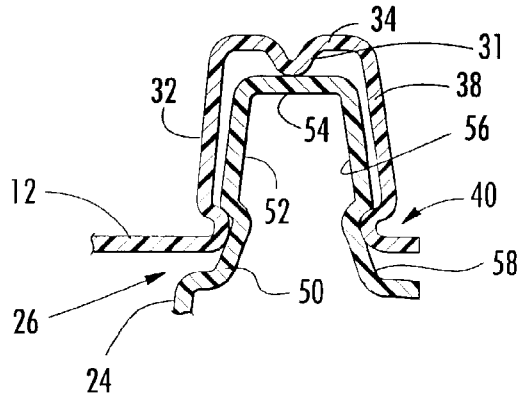

As the lid is pressed further down onto the bowl, the seal ring 36 contacts the top 54 of the bowl lip 26, as shown in FIG. 2B. As shown in FIG. 2C, the inner hook 30 subsequently engages the inner undercut 50. The force applied by the consumer to the main body 12 of the lid, which is shown simplified in FIG. 2C as a force A, along with the engagement of the inner hook 30 with the inner undercut 50 and the contact of the seal ring 36 with the top 54 of the bowl lip 26, may cause the lid lip 16 to deflect as shown in FIG. 2C. This deflection may cause the outer hook 40 to move away from the outer undercut 58. The deflection shown in FIG. 2C is caused by the force A creating a moment arm about the point of contact between the seal ring 36 and the top 54 of the bowl lip 26 whereby the inner wall 32 of the lid lip 16 is pressed closer to the wall 52 and the outer wall 38 rotates away from the outer wall 56 of the bowl lip 26. As the force A is released, the lid springs back and the outer wall 38 moves closer to the outer wall 56 of the bowl 10. In this way, the outer hook 40 moves towards the undercut 58 and either engages the outer undercut 58 or is pressed into engagement by application of a force B, shown in FIG. 2C, by the consumer. The force B, of course, may be applied in other places, such as anywhere along the half of the top 34 on the outside of the seal ring 36, along the outer wall 38, or near or on the outer hook 40.

FIGS. 3A–3D show a second embodiment of the invention in which the inner hook 30 is disposed in relation to the outer hook 40 in such a way that the outer hook 40 will engage the outer undercut 58 before the inner hook 30 engages the inner undercut 50. Other aspects of the second embodiment, to the extent they are the same as those of the first embodiment, will not be discussed in detail.

Figure 3A:
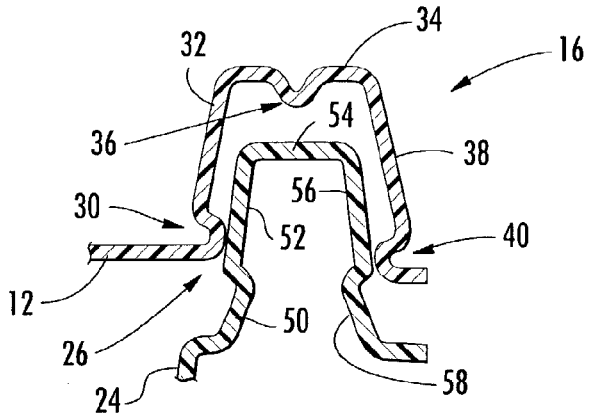
FIGS. 3A–3D are partial cross-sectional views of lid and bowl lips according to a second embodiment of the present invention showing how the lid engages the bowl.
Figure 3B:
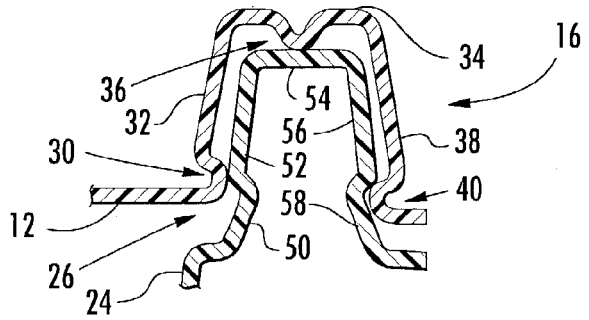
Figure 3C:
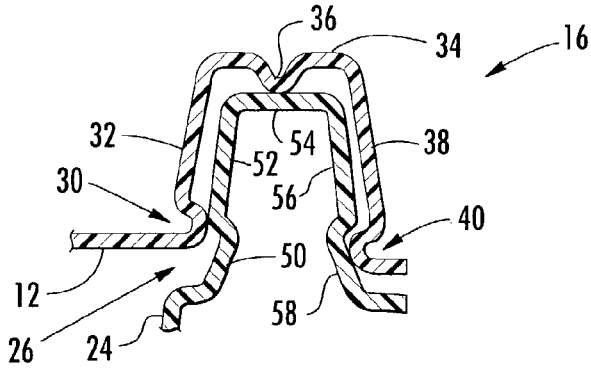
Figure 3D:
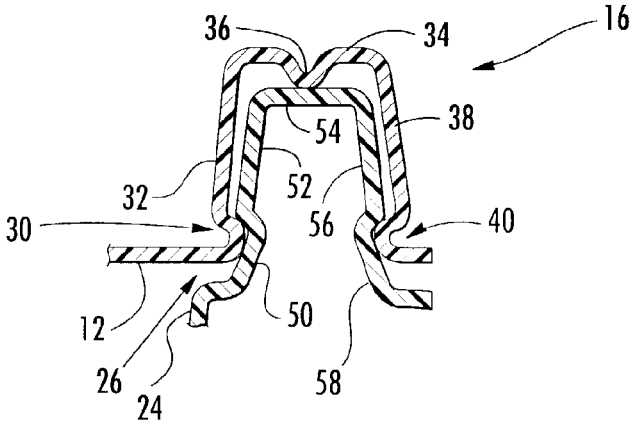

FIGS. 3A–3D show the engaging process of the second embodiment. As shown in FIG. 3A, the lid is placed on the bowl and pressed down, during which the inner and outer hooks 30, 40 slide along the walls 52, 56 and are forced away from each other by the walls 52, 56 in the same manner as in the first embodiment. As in the first embodiment, the outer hook 40 engages the outer undercut 58 before the seal ring 36 contacts the top of the bowl lip 26 and the inner hook 30 engages the inner undercut 50. As shown in FIG. 3B, as the lid is pressed down further, the sealing ring 36 contacts the top 54 of the bowl lip 26. As shown in FIG. 3C, the increased length of the outer wall 38 of the lid lip 16 allows the outer hook 40 to move past the top of and slide along the outer undercut 58. As additional force is applied to the lid, the sealing ring 36 again acts as a fulcrum, as it did in the first embodiment. However, unlike the first embodiment, the fulcrum effect in this embodiment causes the outer hook 40 to move up and to contact the top of the outer undercut 58, thus "cinching up" the engagement of the outer hook 40 with the outer undercut 58. Therefore, in the second embodiment, no secondary force needs to be applied to engage the outer hook 40 with the outer undercut 58. The end result is the arrangement shown in FIG. 3D.

Figure 4A:
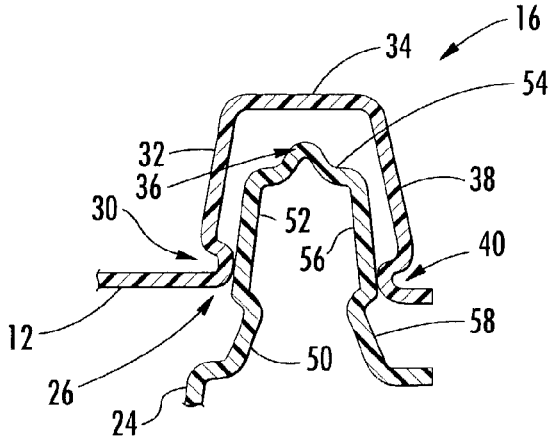
FIGS. 4A–4D are partial cross-sectional views of lid and bowl lips according to a third embodiment of the present invention showing how the lid engages the bowl.
Figure 4B:
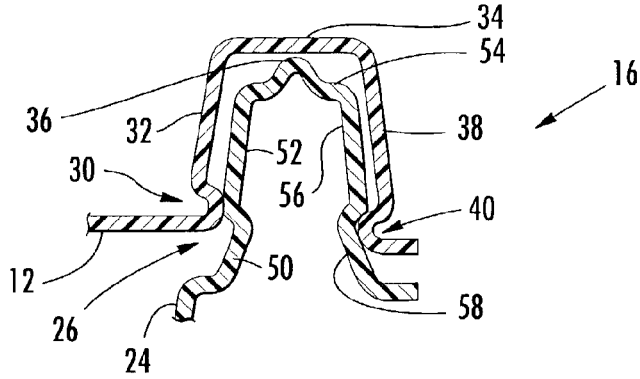
Figure 4C:
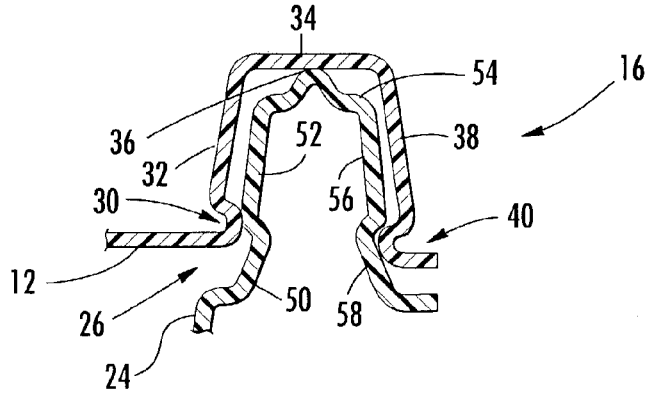
Figure 4D:
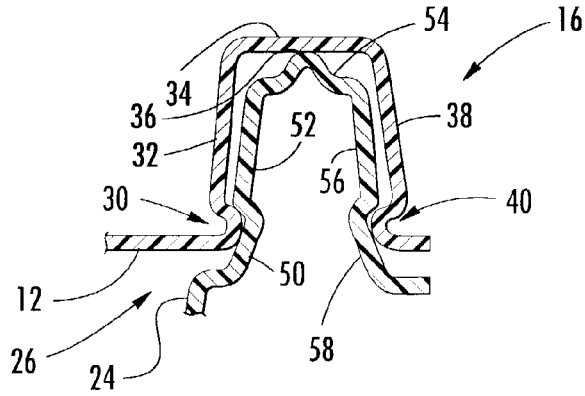

FIGS. 4A–4D show the engaging operation of a third embodiment, which is the same as the second embodiment in all aspects except that the sealing ring 36 is disposed on the top 54 of the bowl lip 26. As shown in FIGS. 4A and 4B, as the lid is pressed down, the inner and outer hooks 30, 40 slide along the walls 52, 56 of the bowl lip 26 until the outer hook 40 engages the outer undercut 58. As shown in FIG. 4C, as the lid is pushed down further, the sealing ring 36 on the top 54 of the bowl lip 26 contacts the top 34 of the lid lip 16 and the outer hook 40 moves down past the top of the outer undercut 58. As the lid is pressed down even further, the inner hook 30 engages the inner undercut 50 and the sealing ring 36 acts as a fulcrum to cinch up the engagement between the outer hook 40 and the outer undercut 58 in the same manner as described with regard to the second embodiment.

In each of the first, second and third embodiments, the inner and outer hooks 30, 40 engage inner and outer undercuts 50, 58 to resist lifting of the lid from the bowl. The hooks 30, 40 may also squeeze or clamp the undercuts 50, 58. This clamping effect, if any, is a result of the dimensions of the lid and bowl. That is, the main body 12 of the lid is oversized so that the lid has to be squeezed to fit into the opening of the bowl, thus causing the inner hook 32 to press against the inner wall 52 of the bowl lip 26. In addition, the width of the top 34 of the lid lip 16 is such that the outer hook 40 presses against the outer wall 56 of the bowl lip 26. Thus, the lid is held on the bowl and the seal ring 36 is brought into a relatively high pressure contact with its opposing surface.

Also, in the foregoing embodiments, the lid lip 16 and the bowl lip 26 are substantially out of contact with each other. The lid lip 16 and the bowl lip 26 only contact at the inner and outer hooks 30, 40 and the seal ring 36. The inner and outer hooks 30, 40 contact over a small area relative to the total surface area of the bowl lip 26 in order to permit the hooks 30, 40 to engage the undercuts 50, 60 and minimize the significance of manufacturing tolerances. The seal ring 36 contacts its opposing surface over a relatively small surface area to generate a relatively high pressure contact, and also to minimize the significance of manufacturing tolerances. We prefer such a small surface area between the lid lip 16 and the bowl lip 26 to be substantially a line contact.

The embodiments shown in FIGS. 5A–5D and 6 are the same in all aspects as those shown in FIGS. 1, 2A–2D, 3A–3D and 4A–4D, except that the seal ring 36 is provided on one of the walls of the lid lip 16 and only one undercut 50 is provided.

Figure 5A:
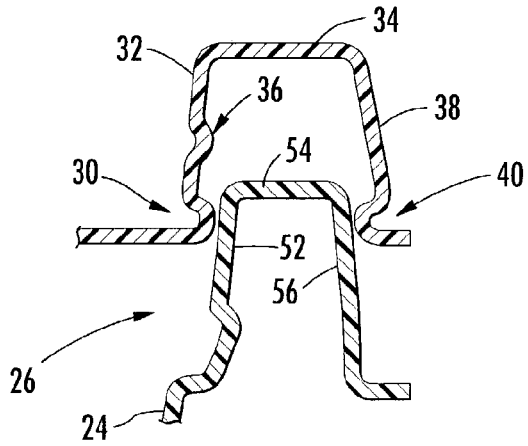
FIGS. 5A–5D are partial cross-sectional views of lid and bowl lips according to a fourth embodiment of the present invention showing how the lid engages the bowl.
Figure 5B:
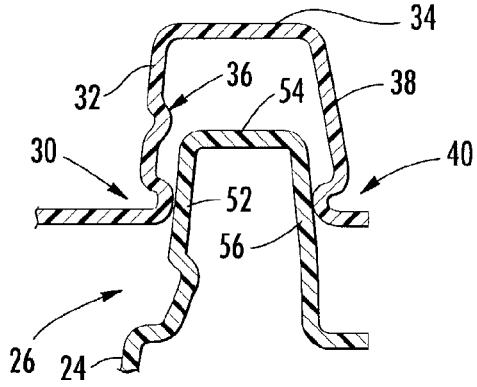
Figure 5C:
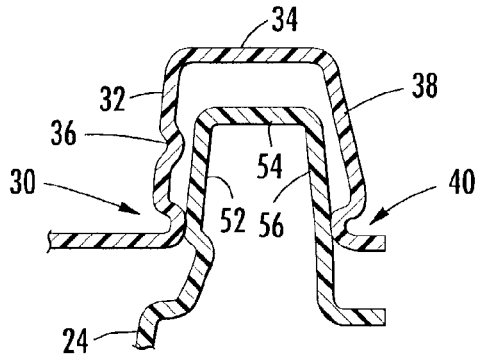
Figure 5D:
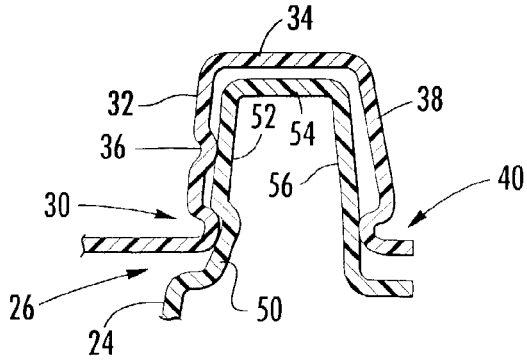

As shown in FIGS. 5A–5C, in the fourth embodiment, the inner and outer hooks 30, 40 slide along the walls 52, 56 of the bowl lip 26 as the lid is pressed down on the bowl. When the inner hook 30 is just above the inner undercut 50, as shown in FIG. 5C, the sealing ring 36 contacts or nearly contacts the inner wall 52. As shown in FIG. 5D, when the lid is fully engaged with the bowl, the inner hook engages the inner undercut 50 and the sealing ring 36 is brought into firm contact with the inner wall 52 by virtue of the clamping action between the inner and outer hooks 30, 40.

Figure 6:
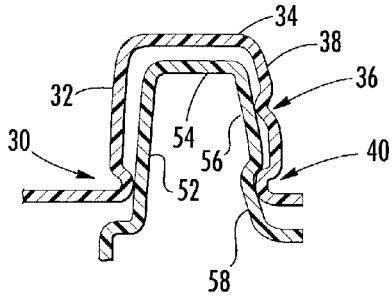
FIG. 6 is a partial cross-sectional view of lid and bowl lips according to a fifth embodiment of the present invention showing the lid and the bowl engaged.

FIG. 6 shows a fifth embodiment that is the same as the fourth embodiment in all aspects except that the single undercut is placed on the outside of the bowl lip 26 and the seal ring 36 is placed on the outside wall 38 of the lid lip 16.

In each of the foregoing embodiments, either of the inner hooks 30 or the outer hooks 40 may be continuous or intermittent. Likewise, the inner and outer undercuts 50, 58 may be continuous or intermittent, but at any rate preferably are positioned to engage the inner or outer hooks 30, 40, respectively.

Also, at least in the embodiments shown in FIGS. 5A–5D and 6, the dimensions of the lid lip 16 and the bowl lip 26 are such that the bowl lip 26 is squeezed or clamped between the inner and outer hooks 30, 40 of the lid lip 16. Moreover, the various components are dimensioned so that the seal ring 36 is brought into firm contact or substantial abutment with its opposing surface. In other words, the inner and outer hooks 30, 40, the inner and outer undercuts, the outward cant of the inner and outer walls 52, 56 of the bowl lip 26 and the width of the tops 34, 54 are such that the lid is firmly held on the bowl so that the seal ring 36 is held by relatively high pressure against its opposing surface and also so that the lid will not pop off the bowl during normal use, even if a full container 2 is dropped onto a hard surface, such as a floor. Moreover, it is believed that the small area of contact and the concomitant relatively high pressure generated between the seal ring 36 and its opposing surface creates a superior seal.

Figure 7:
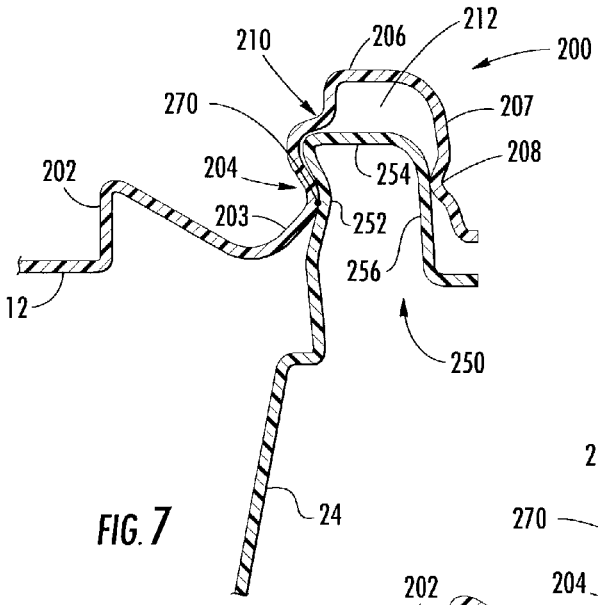
FIGS. 7 and 8 are partial cross-sectional views of lid and bowl lips according to a sixth embodiment of the present invention showing two stages in the process of the lid engaging the bowl.

A sixth embodiment involves a variation on the clamping feature of the previous embodiments. As shown in FIG. 7, the sixth embodiment includes a lid having a spring formation 202 formed on the periphery of the main body 12. The spring formation 202 is in the shape of a right triangle with a vertical side extending from the main body 12 and a hypotenuse giving way into a quasi-parabolic curve. An arcuate section 204 follows a lead in section 203 and is concave away from the bowl. A plurality of reversing curves 210 lead from the arcuate section 204 to a substantially horizontal top 206. A substantially vertical outer wall 207 includes an outer hook 208. The outer hook 208 may be continuous or intermittent.

The bowl lip 250 includes an undercut 252 that leads into a substantially horizontal top 254, which in turn leads into a substantially vertical outer wall 256. The undercut 252 is shaped to substantially interfit with the arcuate section 204 in a lid lip 200. Above this undercut 252 and arcuate section 204, a seal 270 is formed between the lid lip 200 and the bowl lip 250 at the arcuate section 204.

As shown in FIG. 7, the reversing curves 210 provide a space between the top 206 of the lid lip 200 and the top 254 of the bowl lip 250. This space creates a cavity 212. The dimensions of the reversing curves 210 are not critical to the invention, nor is the size of the cavity 212. However, a cavity 212 of some substantial size is preferred to avoid interference, considering manufacturing tolerances, between the lid lip 200 and the bowl lip 250 when the lid and the bowl are engaged, as shown in FIG. 7. The seal 270 results from the spring element 202 pushing the lid lip 200 against the bowl lip 250.

In the sixth embodiment, to the extent that the spring formation 202 buckles, the spring formation 202 increases resistance to opening from pressure coming from the bottom of the lid. Such pressure may be generated by food in the container pressing upon the bottom of the lid. However, such buckling that increases the resistance to opening would not occur when a force is applied from a different direction, such as, for example, when a user presses up on the tab 14 shown in FIG. 1 to remove the lid from the bowl. Therefore, the spring formation 202 would not increase the difficulty of intentionally removing the lid from the bowl.

Figure 8:
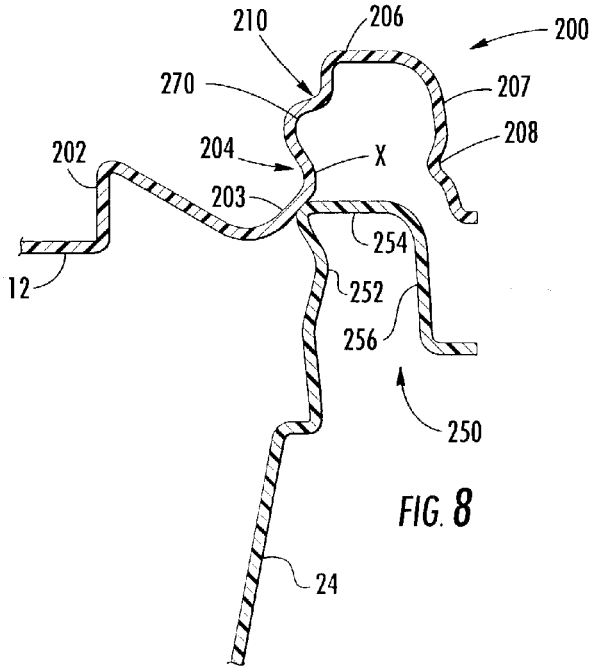

The process of engaging the lid lip 200 with the bowl lip 250 of the sixth embodiment is best illustrated with reference to FIGS. 7 and 8. As shown in FIG. 8, when the lid is placed on the bowl, the lead-in portion 203 rests against the bowl lip 250 where the top 254 intersects the undercut 252. It should be understood that the bowl lip 250 may not contact in exactly the portion of the lead-in portion 203 as shown in FIG. 8, and dimensions may vary slightly even though the principle of operation is the same.

When a consumer presses on the lid, the lead-in portion 203 slides along the bowl lip 250. As the lead-in portion 203 slides against the bowl lip 250, the spring formation 202 compresses, enabling the lid to further slide into the opening in the bowl. Then, the arcuate portion 204 slides against the bowl lip 250 until point X is reached, at which point the lid lip 200 rapidly moves down on the bowl lip 250 as a result of the continued pressure and the change in direction of the arcuate portion 204. This rapid movement may cause a snapping sound as the lid lip 200 and the bowl lip 250 engage. After engagement, the lid lip 200 and the bowl lip 250 are arranged as shown in FIG. 7.

Figure 9:
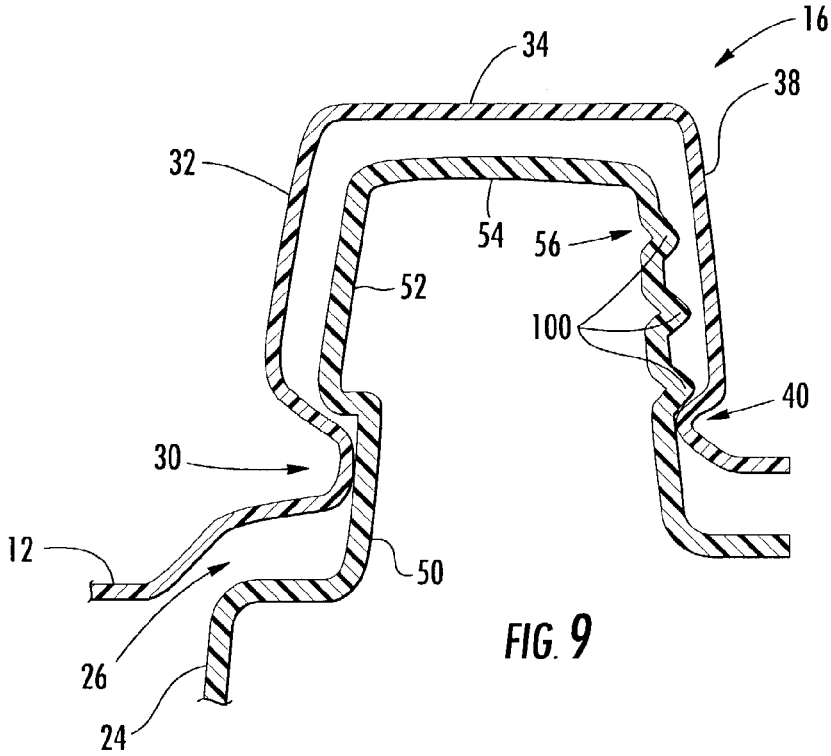
FIG. 9 is a partial cross-sectional view of lid and bowl lips according to a seventh embodiment of the present invention.

As shown in FIG. 9, a seventh embodiment includes one or a plurality of rumble strips 100. As in the other embodiments, the lid lip 16 includes an inner hook 30 and an outer hook 40. The inner and outer hooks 30, 40 are shown in FIG. 9 as having slightly different shapes from each other and from the other embodiments, but the general shape of the inner and outer hooks is the same in all instances. The inner hook 30 is the primary seal in this seventh embodiment and is pressed against the undercut 50 because, as in the other embodiments, the main body 12 of the lid is larger than the opening of the bowl such that an interference fit is created between the lid and the bowl.

The rumble strips 100 provide audible and tactile feedback to a consumer. As the lid is forced down onto the bowl, the outer hook 40 encounters the rumble strips 100 and may generate a sound as it passes over the rumble strips 100. In addition, the rumble strips 100 may send vibrations through the lid, thus generating tactile feedback.

Figure 10:
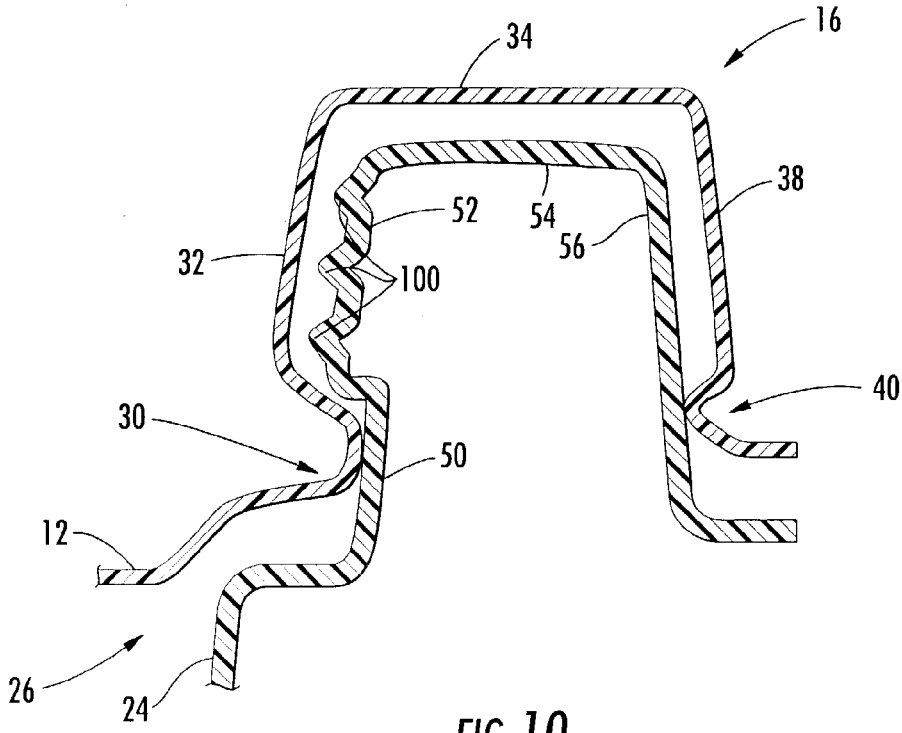
FIG. 10 is a partial cross-sectional view of lid and bowl lips according to an eight embodiment of the present invention, showing a variation of the embodiment shown in FIG. 9.

The embodiment shown in FIG. 10 is the same in all respects as that shown in FIG. 9, except that the rumble strips 100 are provided on the inner wall 52 of the bowl lip 26. In this embodiment, the inner hook 30 passes over the rumble strips 100 to generate sound.

Figure 11:
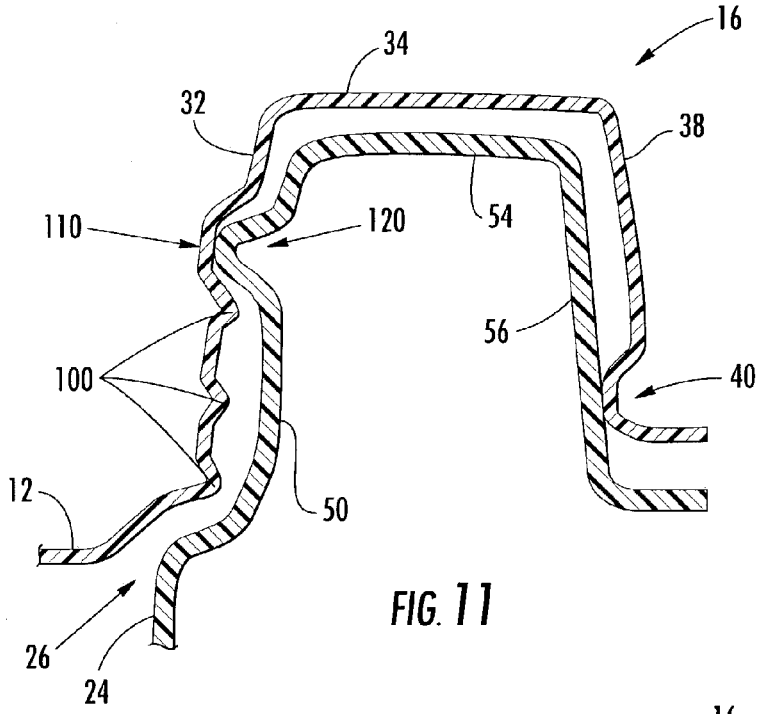
FIG. 11 is a partial cross-sectional view of lid and bowl lips according to a ninth embodiment of the present invention.

A ninth embodiment is shown in FIG. 11, in which the lid lip 16 includes a primary seal receptor 110 formed on the lid lip 16 and a primary seal protrusion 120 formed on the bowl lip 26. Below the primary seal receptor 110 are the plurality of rumble strips 100. The protrusion 120 is preferably substantially larger than the rumble strips 100, although the protrusion may be the same size as the rumble strips. Also, in the ninth embodiment, the inner undercut 50 is substantially longer than that in the seventh and eighth embodiments, all other dimensions being equal. The large inner undercut 50 keeps the bowl lip 26 and the lid lip 16 out of contact with each other at that location to avoid any interference with the operation of the primary seal receptor 110 and protrusion 120.

In this embodiment, as the lid is placed on the bowl, the plurality of rumble strips 100 passes over the seal protrusion 120, creating aural and tactile feedback. When the lid is pressed all the way down, the primary seal receptor 110 and the primary seal protrusion 120 interfit, and are in firm contact because of the interference fit between the lid and the bowl and the clamping effect of the outer hook 40, as in the previous embodiments.

Figure 12:
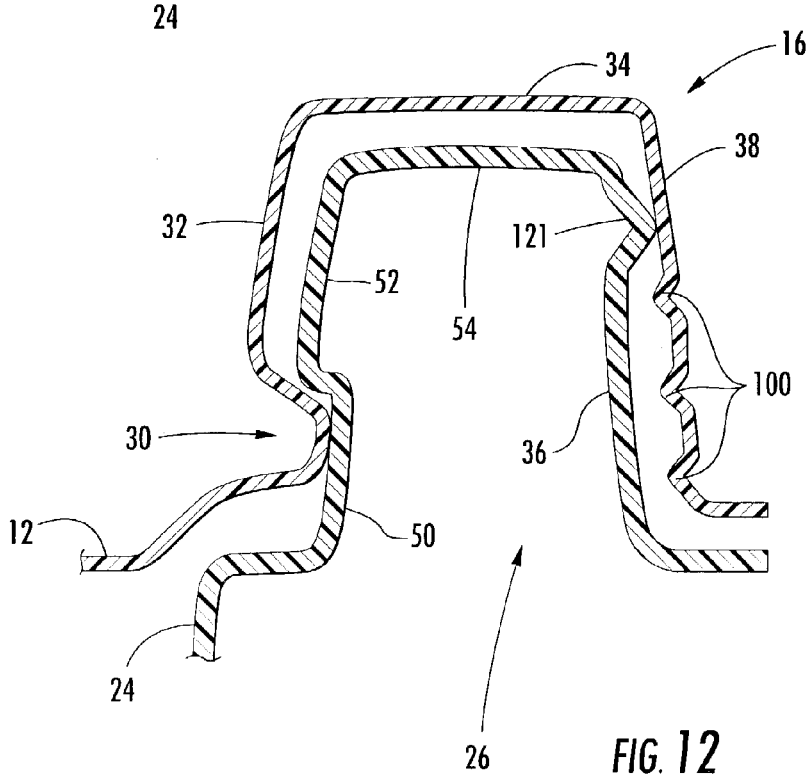
FIG. 12 is a partial cross-sectional view of lid and bowl lips according to a tenth embodiment of the present invention.

Another embodiment is shown in FIG. 12, in which an inner hook 30 engages an inner undercut 50, forming a primary seal, and a projection 121 on the bowl lip 26 is provided on the outer wall 56. In this embodiment, the rumble strips 100 create sound and tactile feedback by rubbing against the projection 121. The projection 121 may also form a secondary seal if brought into firm contact, or substantial abutment, with the outer wall 56. Such firm contact may be achieved by creating a clamping effect, whereby the lid lip 16 squeezes the bowl lip 26.

Figure 13:
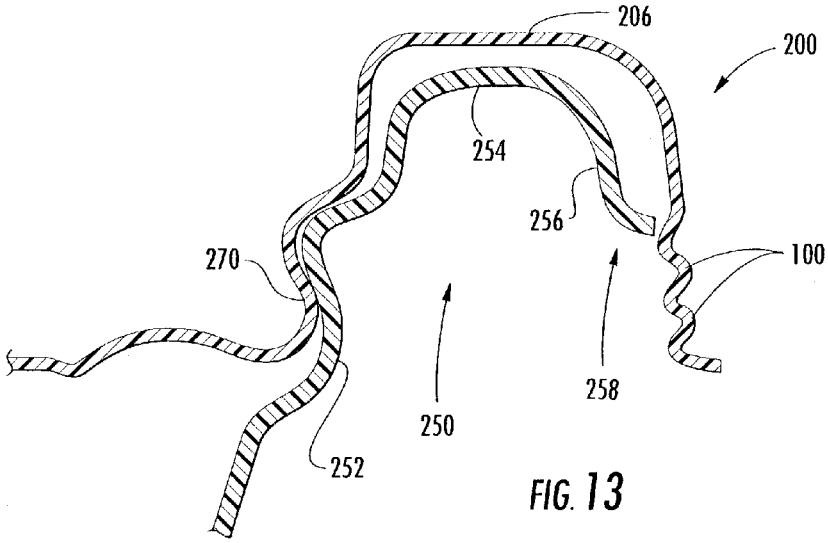
FIG. 13 is a partial cross-sectional view of lid and bowl lips according to an eleventh embodiment of the present invention.
Figure 14:
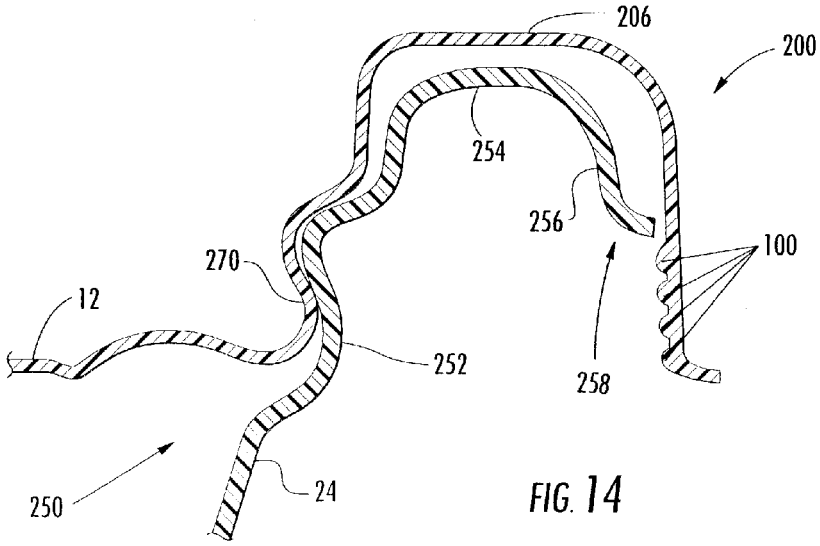
FIG. 14 is a partial cross-sectional view of lid and bowl lips according to a twelfth embodiment of the present invention, showing a variation of the embodiment shown in FIG. 13.

The rumble strip concept can be adapted for the lid lip 200 and the bowl lip 250 of the sixth embodiment, as shown in FIGS. 13 and 14. The embodiments shown in FIGS. 13 and 14 are shown without the spring element 202 of the sixth embodiment. However, this spring element 202 may also be provided for the embodiment of FIGS. 13 and 14, if desired. Another difference between the embodiments shown in FIGS. 13 and 14 and the sixth embodiment shown in FIGS. 7 and 8 is that the bowl lips 250 of FIGS. 13 and 14 have a shorter outer wall 256 that terminates in an outwardly extending flange 258, such that the entire top surface of the bowl lip 250 is covered by the lid lip 200. Accordingly, the embodiments shown in FIGS. 13 and 14 do not have the clamping feature of the sixth embodiment, in which the bowl lip 250 is squeezed or clamped on both its inside and its outside.

The seal 270 in the embodiments shown in FIGS. 13 and 14 is formed where the lid lip 200 contacts the undercut 252 of the bowl lip 250 and, like the other embodiments, is a seal area of small area relative to the total surface area of the bowl lip 250. Other than the seal 270, any contact between the bowl lip 250 and the lid lip 200 is incidental, such that the bowl lip 250 and the lid lip 200 are substantially out of contact with each other. The reason to reduce contact between the bowl lip 250 and the lid lip 200 is to reduce the significance of manufacturing tolerances and to ensure that contact occurs where it is intended (i.e., at the seal 270) without interference from other parts of the bowl lip 250 or lid lip 200.

The primary difference between the embodiments shown in FIGS. 13 and 14 is in the manner of forming the rumble strips 100. In FIG. 13, the rumble strips 100 are formed by reversing curves, while in FIG. 14 the rumble strips 100 are formed by localized and discrete changes in thickness of the material. Nevertheless, in both of FIGS. 13 and 14, the rumble strips are sized to extend further inward than the distance the outwardly extending flange of the bowl lip extends outward. By so sizing the rumble strips, the outwardly extending flange of the bowl lip 250 will rub against the rumble strips as the lid lip 200 is pushed down onto the bowl lip 250.

Figure 15:
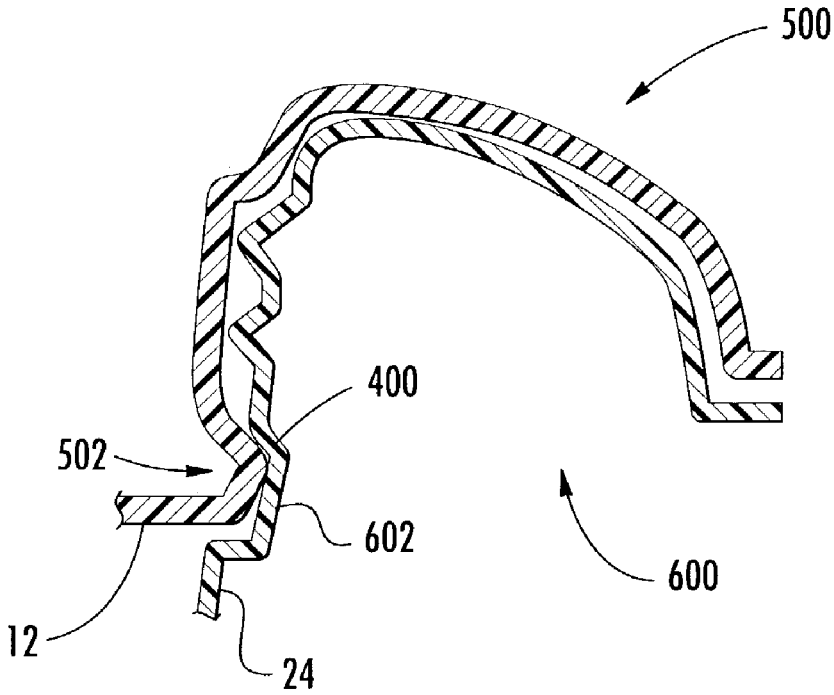
FIG. 15 is a partial cross-sectional view of lid and bowl lips according to a thirteenth embodiment of the present invention.

In yet a further embodiment, shown in FIG. 15, a primary seal 400 is formed between a lid lip 500 and a bowl lip 600 by virtue of an inner hook 502 firmly contacting an inner undercut 602. This firm contact is generated by the interference fit between the bowl and the lid, whereby the main body portion 12 is larger than the opening in the bowl. The remainders of the bowl and lid lips, other than the primary seal 400, are substantially out of contact with each other, as shown in FIG. 15. Indeed, the bowl and lid lips 500, 600 may even be more spaced than shown in FIG. 15. In this embodiment, as in the embodiments shown in FIGS. 13 and 14, the lid lip 500 completely covers the top surface of the bowl lip 600. The inner hook 502 rides over the rumble strips 100 to generate a sound and tactile feedback for the user as the user presses the lid down over the bowl.

It should be understood that the rumble strips shown in FIGS. 9–15 are not exclusive to the particular configurations for the bowl lip and the lid lip shown, but rather could also be used with the seal ring embodiments shown in FIGS. 1–9.

While the present invention has been described with respect to what are at present considered to be the preferred embodiments, it should be understood that the invention is not limited to the disclosed embodiments. To the contrary, as exemplified above, the invention is intended to cover various modifications and equivalent arrangements included within the spirit and scope of the appended claims. Therefore, the scope of the following claims is intended to be accorded the broadest reasonable interpretation so as to encompass all such modifications and equivalent structures and functions.

INDUSTRIAL APPLICABILITY

The container according to the invention provides consumers with an inexpensive container that exhibits some of the characteristics of more expensive containers, such as a superior seal between a bowl and a lid. In addition, the container may provide aural or tactile feedback to indicate that the lid is secured to the bowl.

We claim:

1. A container comprising:

a lid including a lid lip having a generally inverted U-shape and an inner hook and an outer hook; and a bowl including a bowl lip having a generally inverted U-shape and an undercut formed proximate to a bottom of an inner surface of said bowl lip, wherein said lid lip and said bowl lip interfit, forming mutually opposing surfaces, with said lid lip superposing said bowl lip, wherein said bowl lip and said lid lip are dimensioned such that said inner hook and said outer hook contact and clamp said bowl lip when said lid lip and said bowl lip are interfit, wherein said inner hook clamps said bowl lip below a top of said undercut, and wherein at least one of said bowl lip and said lid lip includes sealing means in firm contact with the opposing surface, said sealing means contacting the opposing surface in a small area relative to a total surface area of said bowl lip.

2. A container according to claim 1, wherein said sealing means includes a sealing ring having a curved shape to contact the small area of said opposing surface.

3. A container according to claim 1, further comprising rumble strips disposed on a side wall of one of said bowl lip and said lid lip to generate feedback to a user as said lid lip is interfit with said bowl lip.

4. A container according to claim 1, wherein each of said inner and outer hooks has a curved shape to contact a small area of said bowl lip relative to the total external surface area of said bowl lip.

5. A container comprising:

a bowl comprising a base, a sidewall defining an opening, and a bowl lip having a generally inverted U-shape and including at least one undercut formed proximate to a bottom of an inner surface of said bowl lip; and a lid comprising a main body portion being oversized with respect to the opening of said bowl and a lid lip disposed on a periphery of said main body portion, said lid lip having a generally inverted U-shape such that said lid lip and said bowl lip interfit, with said lid lip superposing said bowl lip, said lid lip including an inner hook and an outer hook each having a curved shape to contact a small area of said bowl lip relative to a total external surface area of said bowl lip when said lid is secured to said bowl, said bowl lip and said lid lip being dimensioned such that said inner hook and said outer hook clamp said bowl lip and said inner hook engages said undercut, said inner hook being in firm contact with said undercut when said lid is secured to said bowl, at least one of said bowl lip and said lid lip including rumble strips for generating feedback to a user as said lid is placed on said bowl.

6. A container according to claim 5, wherein said rumble strip is disposed on said base lip and contacts one of said inner and said outer hooks to generate the feedback to the user as said lid is placed on said bowl.

7. A container comprising:

a bowl comprising a base, a sidewall defining an opening, and a bowl lip having a generally inverted U-shape and including at least one undercut formed proximate to a bottom of an inner surface of said bowl lip; and a lid comprising a main body portion being oversized with respect to the opening in said bowl and a lid lip disposed on a periphery of the main body portion, said lid lip having a generally inverted U-shape such that said lid lip and said bowl lip interfit with said lid lip superposing said bowl lip, said lid lip including an inner hook and an outer hook shaped to contact a small area of said bowl lip relative to a total external surface area of said bowl lip when said lid is secured to said bowl, wherein said bowl lip and said lid lip are dimensioned such that said inner hook and said outer hook contact and clamp said bowl lip when said lid is secured to said bowl, and said inner hook contacts said bowl lip below a top of said undercut causing said lid lip to clamp said bowl lip, and wherein at least one of said bowl lip and said lid lip includes rumble strips for generating feedback to a user as said lid is placed on said bowl.

8. A container comprising:

a bowl comprising a base, a sidewall defining an opening and a bowl lip disposed on a periphery of said sidewall, said bowl lip including an undercut formed at a bottom of an inner surface thereof;

a lid comprising a main body portion, a lid lip disposed on a periphery of said main body portion, said bowl lip and said lid lip adapted to interfit, said lid lip including a first hook and a second hook, wherein the first hook and the second hook contact and clamp said bowl lip when said lid lip and said bowl lip are interfit, and one of the first hook and the second hook is disposed below a top of said undercut when said bowl lip and said lid lip are interfit, wherein one of said bowl lip and said lid lip includes rumble strips and the other of said bowl lip and said lid lip successively engages said rumble strips as said lid lip and said bowl lip are interfit, thereby generating feedback to a user.

9. A container according to claim 8, wherein said main body portion of said lid is oversized relative to the opening in said bowl, a seal is formed as a result of said lid pressing against said bowl, and said seal is disposed at or near where said main body portion and said lid lip intersect.

10. A container according to claim 8, wherein said bowl lip and said lid lip have an inverted U-shape with said first hook and said second hook being formed on inner and outer walls of said lid lip.

11. A container according to claim 9, wherein said bowl lip and said lid lip are substantially out of contact with each other, except for said seal.

12. A container according to claim 8, wherein said bowl lip includes said rumble strips and one of said first hook and said second hook successively engages said rumble strips when said lid is interfit with said bowl.

13. A container according to claim 12, wherein said first hook and said second hook in said lid lip contacts said bowl lip over a small area relative to a total surface area of said bowl lip, the contact between said first and second hooks and said bowl lip forming a seal.

* * * * *